United States Patent [19]

Stark

[11] Patent Number: 4,495,884

[45] Date of Patent: Jan. 29, 1985

[54] BOAT CONSTRUCTION AND METHOD

[75] Inventor: Terry R. Stark, Newport, N.C.

[73] Assignee: Williams Lumber Yard, Beaufort, N.C.

[21] Appl. No.: 492,491

[22] Filed: May 6, 1983

[51] Int. Cl.[3] ..... B63B 5/24
[52] U.S. Cl. ..... 114/357
[58] Field of Search ..... 114/355, 357, 358

[56] References Cited

U.S. PATENT DOCUMENTS

| | | | |
|---|---|---|---|
| 1,469,220 | 10/1923 | Kemp . | |
| 1,842,736 | 1/1932 | Stout . | |
| 2,300,760 | 11/1942 | Amigo | 18/55 |
| 2,454,719 | 11/1948 | Scogland | 154/110 |
| 2,482,798 | 9/1949 | Rheinfrank, Jr. et al. | 244/123 |
| 2,607,104 | 8/1952 | Foster | 28/72 |
| 2,737,227 | 3/1956 | Brummel | 154/31 |
| 2,743,465 | 5/1956 | Vogel | 114/358 |
| 3,192,099 | 6/1965 | Beckman et al. | 161/43 |
| 3,282,769 | 11/1966 | Rodman et al. | 156/461 |
| 3,331,173 | 7/1967 | Elsner | 52/309 |
| 3,339,326 | 9/1967 | Derr et al. | 52/309 |
| 3,920,871 | 11/1975 | Johnson | 52/309 |

OTHER PUBLICATIONS

Elliott Company (Brochure), Oct. 1981; 9200 Zionsville Road, Indianapolis, Indiana 46268.

*Applications Manual,* Fifth Edition; Cook Paint and Varnish Co., 1981; P.O. Box 389, Kansas City, Missouri 61141.

"The National Fisherman", Feb. 1983 issue, pp. 94–98.

*Primary Examiner*—Sherman D. Basinger

[57] ABSTRACT

The invention presented herein demonstrates a boat hull and method for providing improved flotation characteristics and stackability for a boat having a high strength-to-weight ratio. The boat is constructed with a preformed hull with outwardly extending sides and having cellular flotation logs positioned at spaced intervals thereon whereupon with normal impact to the hull said logs will not experience cellular degradation due to their rigid encapsulation. The preferred method demonstrates a structure comprising a series of rectangular flotation logs positioned athwartship along the inside bottom of the hull. Between the logs an FRP (fiber reinforced plastic) beam is positioned to absorb and divert shock waves from the logs and to increase the strength of the hull. An FRP layer above the logs completes the encapsulation of the logs and secures them in rigid engagement with the hull. The outwardly extending sides and lack of side flotation members contribute to the compact stackability features of the hull.

9 Claims, 6 Drawing Figures

BOAT CONSTRUCTION AND METHOD

BACKGROUND AND OBJECTIVES OF THE INVENTION

Coast Guard Rules and Regulations for recreational boats as set forth in COMDTINST M16752.2 of Sept. 15, 1978 and specifically Title 33, Chapter 1, Parts 181 and 183 require certification labels stating safe loading capacity be affixed to the hull of boats by manufacturers of less than 20 feet in length. With certain exceptions such boats have flotation quantities as set forth in Subparts E, F, and G of Part 183. Most manufacturers attempt to keep their boats safe for the boating public by meeting the minimum flotation requirements as set forth in the Federal Boat Safety Act of 1971 (amended). However, once a boat has been purchased it is subjected to various forms of compression, and point loading of the hull and deck as may be incurred in usual boating activities including loading and unloading the boat, occasionally running it aground, docking it alongside a pier in rough weather, running in heavy seas or other actions which place stresses on the hull.

Current methods of installation of foam flotation materials in boats do not protect the foam materials from degradation in some cases boats have been constructed whereby the installed foam materials provide the necessary rigidity for the hulls and decks. The most common foam used as a flotation material is a rigid closed cell polyurethane foam having a density of 1.3-3 pounds per cubic foot. This foam is fragile and has a tensile strength of approximately 15–96 p.s.i. and a compressive strength, at 10% deflection of 15–60 p.s.i. A rigid foam material undergoing slight deflection can result in cell damage effectively destroying the flotation ability and even a 10% deflection can cause massive damage to the cellular structure. Conventional construction methods are as follows:

(1) Placing loose logs of foam in the hull deck cavity where they are arranged to move and are unprotected from the forces acting on the hull;

(2) Building a fiberglass hull with from 2 to 4 sets of stringers for overall structural support and blowing the foam in liquid form into the areas between the stringers. The foam is applied within 1 to 5 feet of unsupported hull, which can deflect extensively. The foam, being rigid attempts to prevent this deflection and is quickly damaged; or (3) Constructing a hull and deck structure which is not self-supporting in itself. While still in the original mold, the hull and deck are clamped together and foam in a liquid form is injected into the cavity. The FRP portion of the hull transfers all forces acting on the hull to this foam core thus jeopardizing the cellular integrity of the set foam.

Thus, the present boat construction state of the art which may originally comply with Coast Guard Rules (COMTINST M 16752.2)does little if anything to prevent lowering of the original loading capacity. Also, the methods heretofore used for installing foam flotation materials in boats allows the foam materials to come in contact with water, gas, oil and whatever other substances are commonly found in the hull and deck cavities. When foam, such as rigid polyurethane foam is subjected to sufficient stresses, the cells as heretofore mentioned are damaged or broken and once broken the open cells will absorb and retain fluid in a sponge-like manner. As the cells absorb fluid they resist compression and additional forces to which they may be subjected transfers the forces from the fluid filled damaged cells to adjoining cells causing additional damage or complete destruction. The ability of damaged cellular materials to absorb fluids makes it imperative to protect the cellular structures when employed for flotation purposes and the fact that the damaged cellular materials will not provide the specified flotation properties can be and is a severe current safety problem. Also, as the cellular materials absorb and retain fluid the weight of the boat is increased and in most cases this is unbeknownst to the owner/operator. A severe weight increase can affect the stability and handling properties of the boat and can increase the risk to the occupants. In one known instance the Coast Guard removed a boat of approximately 20 feet in length from service and drained the hull, deck and cavity and found that the boat was approximately 1000 pounds overweight due to fluid absorption which could not be drained from the cellular flotation material.

Absorbed fluids, commonly gasoline and oil can cause severe fire and other hazards. These hazards can be increased as certain designs have their fuel tanks encased in the foam flotation material. It is oftentimes extremely difficult to remove absorbed fluids from the broken cellular materials thus rendering the boat once again safe for its occupants.

With this background in mind the present invention was developed and it is one objective to provide a boat and construction method which will allow the boat to maintain its specified flotation stability and safety characteristics throughout its useful life.

It is still another objective of the present invention to provide a boat hull which will withstand normal impacts without degradation to the cellular flotation members as occurs over the useful life of a boat.

It is yet another objective of the present invention to provide a high strength-to-weight ratio boat hull which can be economically manufactured, and which can be transported at relatively low cost due to its particular stackable features.

It is still another objective of the present invention to provide a boat hull having adequate flotation requirements as set forth in Coast Guard Rules and Regulations in accordance with the Federal Boat Safety Act (as amended), Public Law 92-75 of August 1971.

Another objective of the present invention is to provide a boat which has a hull having a lighter weight per square foot of hull bottom than comparable aluminum boats.

Still another objective of the present invention is to provide a method for boat construction which includes encapsulating cellular flotation logs of specific densities within a boat hull wherein said logs will maintain their cellular integrity throughout the useful life of the boat while undergoing normal stress cycles to the hull.

It is also an objective of the present invention to provide a self-bailing boat construction and method whereby the cellular flotation log members are fully encapsulated to prevent cell degradation by oils or other chemicals and no bridge pump is required to remove water from the hull.

Yet another objective of the present invention is to provide a boat which is stackable in a relative small vertical space requiring no additional side flotation chamber, flotation seats or boxes.

Still another objective of the invention is to provide a boat hull of extremely shallow draft having no interior members to interfere with cleaning or the drainage of water therefrom.

Various other objectives and advantages of the present invention will become obvious to those skilled in the art as the details of the invention are more specifically set forth below.

SUMMARY OF THE INVENTION AND DESCRIPTION OF THE PREFERRED EMBODIMENT

A boat hull and construction method are presented herein having relatively thin sidewalls and a thick bottom which provides safety and usefulness over the life expectancy of the craft. The boat hull has a laterally flat bottom and utilizes cellular flotation log members which are encapsulated below the inner deck to prevent oils, solvents or other chemicals from making contact therewith while allowing the flotation members to be protected from normal impacts to which boat hulls are normally subjected. The method as presented herein demonstrates a boat hull construction which allows the flotation members to be encapsulated by a rigid fiber reinforced plastic (FRP) which prevents degradation of the flotation members upon hull impact as the impact waves are absorbed, reflected or directed between the log members.

The preferred embodiment of the boat hull in the present invention comprises a molded or pre-formed outer shell formed from polyester resins as well known in the fiberglass boat industry. As the hull has flotation log members concealed below the inner deck, when completed the boat is easily stacked in 1/5 the space required of other similar sized boats since the required flotation is included in the bottom construction of the boat and flotation materials are not placed in seats or sides of the boat and since a relatively laterally flat bottom is provided, less stacking space is required and the inner deck of the lower hull can contact the bottom of the upper hull in a stacked configuration.

A female mold is used in preforming the shell of the hull with a mold release agent being sprayed therein prior to applying the first layer of gel coat. (Gel coat as used herein refers to a polyester resin system with certain thixotropic agents and other additives). Various formulations of gel coats can be supplied such as by Cook Paint and Varnish Company of Kansas City, Mo.

After the gel coat has been applied and cured a laminated or reinforced fiberglass coating is applied inside which includes a chopped strand mat having a weight of approximately 7 oz. per square foot. A polyester resin with a suitable catalyst is then applied over the mat either by pouring or spraying and the resin is then worked into the mat, for example with a brush, to insure that the mat is thoroughly saturated and to prevent any air pockets which may form between the gel coat and the mat. Two or three additional layers of FRP (fiberglass reinforced plastic) are then applied as required for specific applications to complete the shell and it has been found sufficient that a three sixteenth (3/16) inch FRP layer be utilized for a typical 20 foot boat.

Prior to the curing of the FRP which has been placed on the inside of the bottom of the shell, a short section of $1\frac{1}{2}$ oz. mat having approximately the inside width of the shell is cut and saturated with a polyester resin catalyst and the trailing edge is positioned athwartwise on the uncured FRP. A suitably dimensional cellular rectangular flotation log member which may be for example 4 inches in width, approximately $3\frac{1}{2}$ inches in height and approximately the inside width of the shell is positioned on the trailing edge of the mat which is in contact with the uncured FRP layer. The mat which may weigh $1\frac{1}{2}$ oz. per square foot as is conventionally used in the trade is then lifted alongside the positioned log member. A second similar trailing edge mat is then positioned also athwartwise on the FRP to abut the raised first mat and a second flotation log member is then placed on the second trailing edge of mat. The leading edge of the first mat is then allowed to overlap the top of the second flotation log member and the step of alternating saturated mats and flotation log members is then continued throughout the dimensions of the shell.

After applying the mat between successive flotation log members has been completed an FRP overlay is begun to complete the encapsulation of the flotation log members. The first layer of a mat of approximately $1\frac{1}{2}$ oz. per square foot is placed over the flotation log members which, as understood, is sprayed or brushed with an appropriate polyester resin/catalyst mixture. Over this layer is positioned another layer of approximately three (3) oz. per square foot chopped fiberglass mat and thereafter a layer of a woven roving is utlilized with a 24 oz. per square yard weight. All layers are appropriately saturated with a proper polyester resin mixture. The FRP layers above the flotation logs may total one quarter ($\frac{1}{4}$) inch in the preferred embodiment and the FRP layer between the flotation logs may be approximately one eighth ($\frac{1}{8}$) of an inch in thickness which in effect forms an "I" beam between the flotation log members.

To complete the top of the inner deck or hull after the FRP layers completely cure, a protective and decorative gel coat is applied and cured which may also consist of a properly selected polyester resin which may be used originally on the female mold to form the outer shell of the hull.

The flotation members as used within the preferred embodiment may consist of cyanurate/urethane logs with enclosed cells having a density of approximately two (2) pounds per cubic foot as measured by ASTM Test Nethod D-1622. This particular cellular foam material must be protected to prevent cell degradation and it has found that the preferred hull structure as outlined above has the necessary strength to prevent normal impacts as are generally encountered to prevent degradation to the flotation members during their useful life expectancy.

DETAILED DESCRIPTION OF THE DRAWINGS

Turning now to the drawings, FIG. 1 demonstrates a typical boat configuration as utilized with the invention herein:

FIG. 2 demonstrates a section of the boat hull cut away to illustrate a typical flotation log placement;

Figure 1:
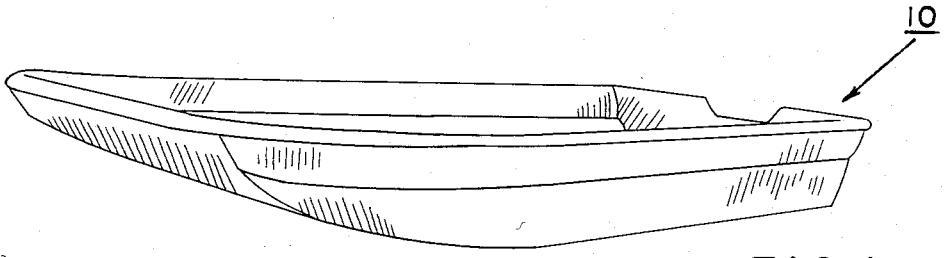
Figure 5:
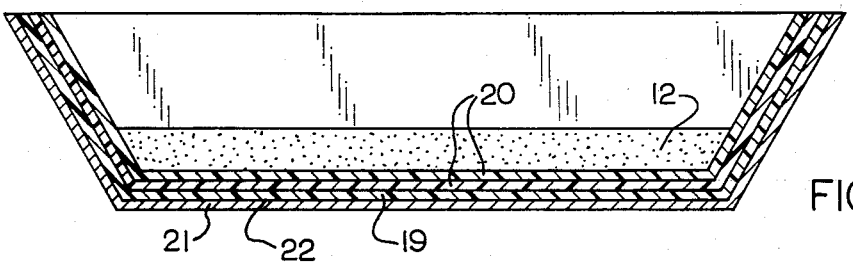
Figure 6:
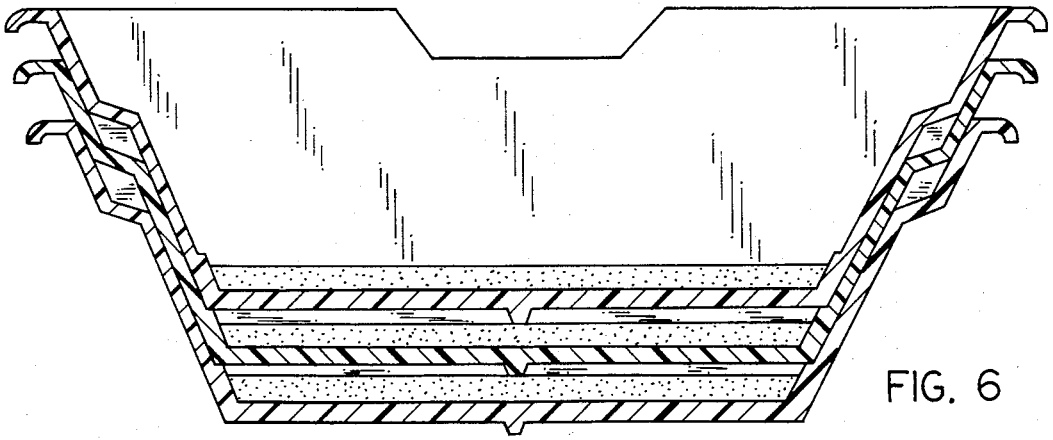

FIG. 5 demonstrates a cross-sectional view of the hull prior to its removal from the mold; and FIG. 6 shows in cross sectional view the stackability of the boats of FIG. 1.

Figure 2:
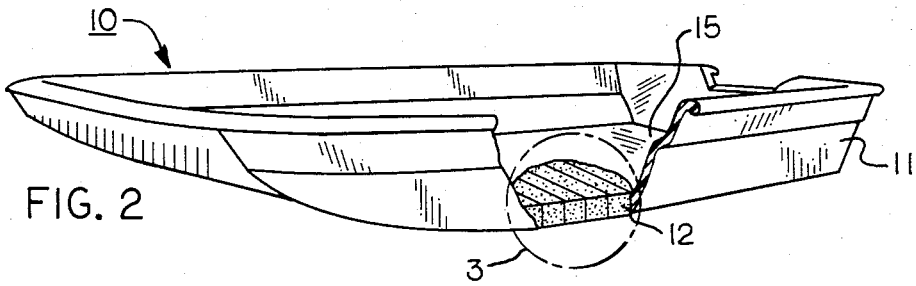

For a more detailed description of the invention, FIG. 2 shows a hull 11 of a typical self-bailing boat 10 of twenty (20) feet or less length having flotation logs 12 positioned longitudinally athwartwise from side to side along the hull. Either longer or smaller boats could also be constructed in this manner and the exact log placement is not critical although the athwartwise placement has been found convenient in this size boat. Fore-and-aft log placement may also be utilized under certain circumstances. The flotation logs 12 as used may be of the urethane, cyanurate/urethane or other compositions having good flotation characteristics which may also be of the closed-cell variety. It has been found that cyanurate/ urethane foam logs having a density of approximately two (2) pounds per cubic foot as measured by ASTM Test Method D-1622 are completely satisfactory for purposes at hand although other densities and types of flotation members may be employed. The urethane foam member used herein are manufactured by Elliott Company of Indianapolis, Indiana and will maintain cellular integrity for loads up to 20 pounds per square inch. When greater loads are directly applied, cell degradation occurs and the flotation properties can be greatly reduced.

As would be understood impact of a sufficient force will destroy the hulls of the boats shown herein and "normal impact" refers to impacts that are encountered under normal sailing or using conditions which all boats are subjected.

Figure 3:
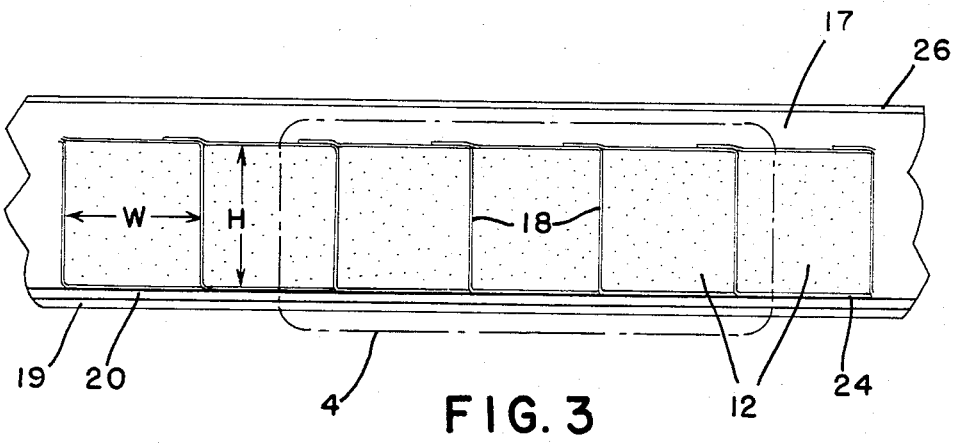
FIG. 3 illustrates the encircled portion of FIG. 2 demonstrating an enlarged end view of the cut-away as shown in FIG. 2.

It has been found that a boat hull can be constructed which will have a high strength-to-weight ratio and which will maintain its flotation properties throughout its useful life by adequately protecting the flotation log member 12 employed so that normal impacts which occur during boating do not allow forces exceeding the maximum degradation limits to reach the flotation members 12. It has been found that cellular flotation log members of a cyanurate/urethane composition can be cut in athwartwise lengths having a width "w" as shown in FIG. 3 of approximately 4 inches and a height "H" of $3\frac{1}{2}$ inches to be completely satisfactory for purposes of the present invention when installed in crafts of 20 feet in length or less. The bottom gel coat as shown in FIG. 5 is approximately 20 mils thick whereas the FRP layer 20 below the flotation log members 12 is approximately 3/16 of an inch as shown in FIG. 3 and the FRP layer 17 above the flotation log members 12 is approximately $\frac{1}{4}$ of an inch thick with an overlay gel coat 26 of also approximately 20 mils in thickness. FRP layers as herein used comprise a material, i.e., mat, roving or the like and a suitable thermosetting resin. The I-beam or FRP portion 18 as shown in FIG. 3 is approximately $\frac{1}{8}$ of an inch in thickness and the thickness adequately transmits shock waves from normal impacts applied above or below log members 12 away and thus prevents cellular degradation to members 12.

Thus, the structure of FIG. 3 has been found to satisfactorily withstand normal impacts without destroying the cellular integrity and the flotation characteristics when subjected to impacts that occur as during boating. Flotation log members 12 are securely held in place by the rigid FRP layers 20, 18, and 17 and impact forces are transmitted between the flotation log member 12 by I-beams or FRP layers 18 therebetween and as stated under normal circumstances will also protect log members 12 from various solvents or liquids.

It is possible to utilize cellular log members 12 having a greater width than provided in the preferred embodiment if the cellular integrity can withstand greater impacts and it is also possible to utilize thinner FRP layers under and above the flotation log members 12. Likewise cellular flotation log members having cellular integrity destroyed by lesser impacts must be of a lesser width than that shown in the preferred embodiment and the FRP layers below, between and above such lower density log members should be adjusted accordingly (increased) to prevent cellular damage. Flotation log members can also be formed from other substances provided they have sufficient flotation qualities and of course other configurations, other than rectangular, can also be used provided they meet requirements set forth in COMDTINST M16752.2.

Figure 4:
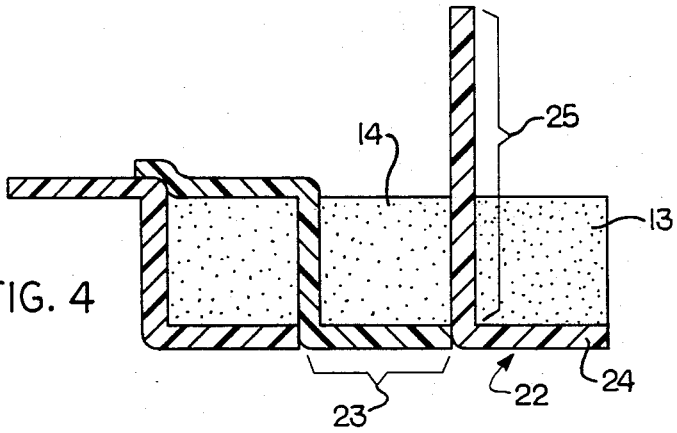
FIG. 4 illustrates an enlarged encircled portion of FIG. 3.

The method as set forth herein provides pre-forming a hull 11 as shown in FIG. 2 in a female mold 21 (see FIG. 5) that has been properly treated with a mold release agent 22 as commercially available. Gel coat 19 (FIG. 3) consists of a polyester resin with catalyst such as available from commercial suppliers such as Cook Paint and Varnish Company of Kansas City, Mo. A FRP overlay 20 is then positioned on said gel coat which may consist of a three layer, approximately 3/16 inch laminate comprising a polyester resin saturated mat material 20 as shown in FIG. 3. Laminate 20 may be approximately 3/16 of an inch thick and lays directly over gel coat 19 which may be approximately $\frac{1}{4}$ of an inch thick. Before the FRP layer 20 is completely cured, a trailing edge 24 of a section of mat 22 as seen in FIG. 4 is placed athwartwise thereon and a first flotation log member 13 is placed on trailing edge 24 as shown in FIG. 4. Mat 22 is lifted (see section 25 in FIG. 4) alongside first flotation log member 13 and a second trailing edge 23 of a second mat 22 is abuttingly fitted against the lower portion of the placed first mat 22 (FIG. 4). A second log member 14 is then placed against the lifted portion 25 of first mat 22 whereby first and second log members 13 and 14 are then separated by the first mat 22 which may be approximately $\frac{1}{8}$ of an inch thick. Next, the top of mat 22 which extends above the flotation members is then layed over on top of second flotation log member 14 and the process is then continued until the hull is completed with flotation log members separated by FRP layers which are referred to herein as I-beams. Next an overlay of a woven roving 17 is then placed on top of log members 12 and mat 22 and additional FRP layers are then overlaid as required to a suitable thickness which may be $\frac{1}{4}$ of an inch. Next, gel coat 26 is applied over the FRP layers, said gel coat may be approximately 20 mils thick as seen in FIG. 3. Gel coat 26 and the FRP layers 17 form the inner deck as shown in FIG. 2 and complete the encapsulation of log members 12.

The described construction provides an impact resistance encapsulating configuration which protects the structural integrity of the cellular flotation log members, and also keeps the log members from moving and being subjected to contact with gasoline, fuel oils, solvents or other materials which may chemically degrade the cellular structures.

Due to the construction of boat hull 11 as shown in FIG. 2, transportation of such completed hulls is relatively inexpensive as they can be readily stacked as shown in FIG. 6. As would be understood, seats and other fixtures can be added to the hull upon delivery to the marina or distributor. Additional boat hulls of similar sizes require approximately 5 times the vertical space when stacked during shipping or storage over the hulls in the present invention. The construction shown also has a high strength-to-weight ratio exceeding aluminum flat bottom boats.

The polyester resins, catalysts, and materials such as mats and rovings are conventional items, and can be modified or varied as required or as availability permits. thermosetting or other resins such as epoxies or other one, two or three part systems may be employed and other materials other than mats and rovings may also be used.

The examples and illustrations shown herein are for illustrative purposes and changes and modifications can be made without departing from the scope of the invention.

I claim:

1. A method of forming a high strength-to-weight ratio boat hull which is stackable so the inner deck of the lower hull can contact the bottom of the upper hull comprising: preforming a polymeric outer shell with outwardly extending relatively thin sides and a laterally flat, relatively thick bottom with respect to said sides, placing a first mat saturated with a hardenable resin on the bottom inside the outer shell, positioning a first flotation log member longitudinally athwartwise from side to side on the first mat, extending said first mat alongside said first log member, abutting said first mat with a second mat placed on the bottom of said shell, placing a second log member beside said first log member athwartwise on said second mat along the bottom of the shell to allow said first log and said second log members to be separated by said first mat, and applying a gel coat over said first log member whereby said log members are totally encapsulated.

2. A method of forming a high strength-to-weight ratio boat hull as claimed in claim 1 and including the step of covering a portion of said second log member with said first mat.

3. A method of forming a high strength-to-weight ratio boat hull as claimed in claim 1 and repeating said method steps with additional mats and additional log members along the inside bottom of said outer shell.

4. A method of forming a high strength-to-weight ratio boat hull as claimed in claim 1 comprising: positioning rectangularly shaped log members athwartwise from side to side along the bottom of said shell.

5. A boat hull having a shallow draft and a high strength-to-weight ratio suitable for stacking one hull inside another so the inner deck of the lower hull can contact the bottom of the upper hull comprising: a polymeric shell, said shell having a relatively thick, laterally flat bottom and relatively thin with respect to said bottom outwardly extending sides, flotation log members, said log members being positioned only longitudinally athwartwise from side to side along the inside bottom of said shell, fiber reinforced I-beams, said I-beams positioned along said log members, an inner deck, said inner deck positioned over said log members and said I-beams whereby said shell, I-beams and said inner deck totally encapsulate said log members for prevention of impact and fluid degradation to said log members and to allow compact vertical storage of two or more hulls.

6. A boat hull as claimed in claim 5 wherein said log members are composed of cyanurate/urethane foam.

7. A boat hull as claimed claim 5 wherein said shell comprises a polyester resin.

8. A boat hull as claimed in claim 5 wherein said inner deck comprises a polyester resin.

9. A boat hull as claimed in claim 5 wherein said I-beam contacts the bottom of said shell and said inner deck.

* * * * *